US008746580B2

(12) United States Patent
Li

(10) Patent No.: US 8,746,580 B2
(45) Date of Patent: Jun. 10, 2014

(54) ACOUSTO-MAGNETIC ANTI-THEFT LABEL WITH A HIGH COERCIVITY BIAS AND METHOD OF MANUFACTURE

(75) Inventor: Lin Li, BeiLun (CN)

(73) Assignee: Ningbo Signatronic Technologies, Ltd, Ningbo, BeiLun (CN)

( * ) Notice: Subject to any disclaimer, the term of this patent is extended or adjusted under 35 U.S.C. 154(b) by 148 days.

(21) Appl. No.: 13/475,764

(22) Filed: May 18, 2012

(65) Prior Publication Data

US 2013/0306744 A1 Nov. 21, 2013

(30) Foreign Application Priority Data

May 20, 2011 (CN) ..... 2011 1 0130954

(51) Int. Cl.
*G06K 19/06* (2006.01)

(52) U.S. Cl.
USPC ..... 235/493; 235/492

(58) Field of Classification Search
CPC ..... G06K 19/00; G06K 19/06; C22C 38/02; C22C 38/38; C21D 8/005; C21D 8/02; C21D 8/1205; C21D 9/00; G08B 13/2408; G08B 13/244; G08B 13/2442; H01F 1/04; H01F 1/147; H01F 1/14775; H01F 1/16
USPC ..... 235/493, 492, 380, 486
See application file for complete search history.

(56) References Cited

U.S. PATENT DOCUMENTS

| | | | | |
|---|---|---|---|---|
| 4,210,843 | A * | 7/1980 | Avadani | 313/403 |
| 4,536,229 | A | 8/1985 | Jin | |
| 4,960,651 | A * | 10/1990 | Pettigrew et al. | 428/607 |
| 5,351,033 | A | 9/1994 | Liu | |
| 5,653,824 | A * | 8/1997 | Manning et al. | 148/306 |
| 5,716,460 | A | 2/1998 | Manning | |
| 5,729,200 | A | 3/1998 | Copeland | |
| 6,001,194 | A | 12/1999 | Nakaoka | |
| 6,020,817 | A | 2/2000 | Copeland | |
| 6,181,245 | B1 | 1/2001 | Copeland | |
| 6,359,563 | B1 | 3/2002 | Herzer | |
| 6,689,490 | B2 | 2/2004 | Weber | |
| 6,893,511 | B1 | 5/2005 | Nakaoka | |
| 7,716,460 | B2 * | 5/2010 | Stempel et al. | 712/240 |
| 2009/0071574 | A1 * | 3/2009 | Sun | 148/537 |

OTHER PUBLICATIONS

Sungho Jin, "High-Remanence Square-Loop Fe-Ni and Fe-Mn Magnetic Alloys", IEEE Transactions on Magnetics vol. Mag-16 No. 5 Sep. 1980.

* cited by examiner

*Primary Examiner* — Thien M Le
(74) *Attorney, Agent, or Firm* — Miller Law Group, PLLC

(57) ABSTRACT

A high coercivity bias piece for making acousto-magnetic labels is made of an alloy strip with 10-14% weight percent Mn, less than 7% weight percent of one or more other transitional metals, with the balance Fe, after cold rolling to final gage, going through a final aging heat treatment at below 590 C, longer than 5 minutes. The strip thickness is 0.065-0.18 mm with coercivity measured by direct current method being 56-90 Oe. The method of making the high coercivity bias piece is to cold roll the strip to 0.07-0.15 mm with aging temperature at 450-570 C, for 0.5-20 hours to form a magnetic strip with coercivity of 60-85 Oe, followed by cutting the strip to required size. This high coercivity bias piece is manufactured without expensive Co and Ni materials, showing that a low cost Fe-(10-14% weight percent Mn) based alloy can be used to make high coercivity bias.

13 Claims, 1 Drawing Sheet

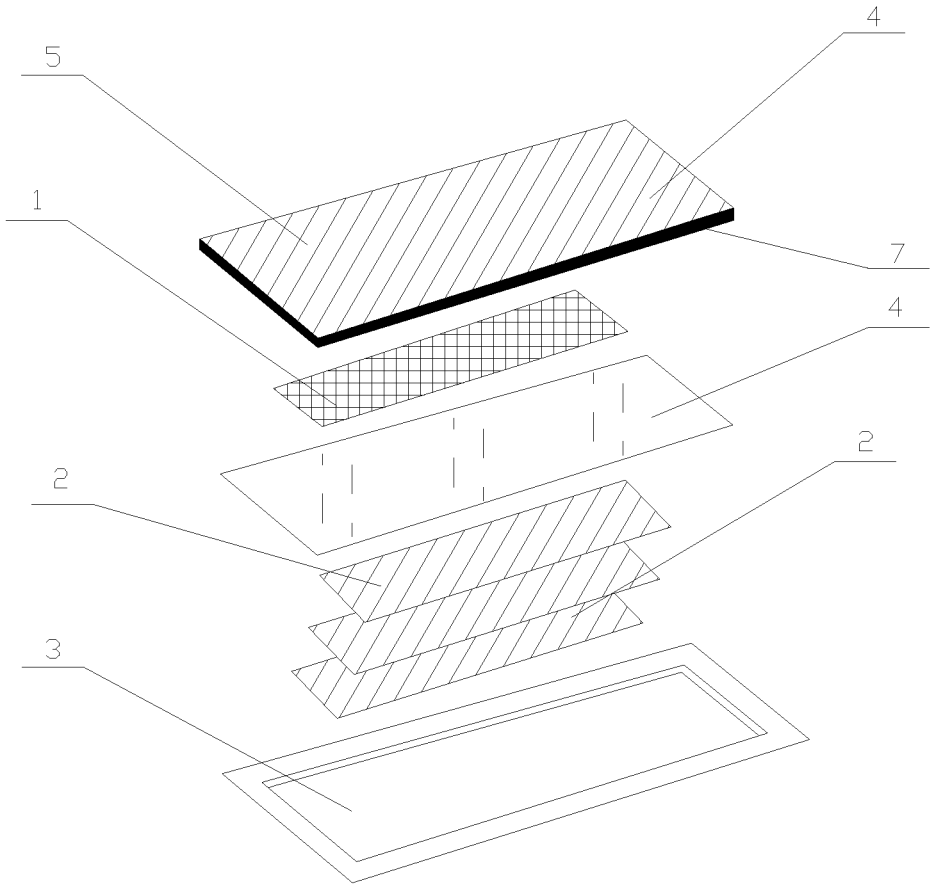
4
5
1
7
4
2
2
3

ACOUSTO-MAGNETIC ANTI-THEFT LABEL WITH A HIGH COERCIVITY BIAS AND METHOD OF MANUFACTURE

FIELD OF THE INVENTION

The present invention relates to a device used in electronic article surveillance (EAS) and its methods of making. More specifically, the present invention is related to a high coercivity (Hc) bias, Co-free, Ni-free or low Ni, that can be manufactured consistently, the acousto-magnetic (AM) anti-theft label made with such a bias, and the method of manufacturing same.

BACKGROUND OF THE INVENTION

Acousto-magnetic technology has been widely used in electronic article surveillance (EAS) for over two decades. The original U.S. Pat. No. 4,510,489, issued on Apr. 9, 1985, to Philip M. Anderson, III, disclosed that some amorphous ribbons have a rather high magneto-elastic coupling factor resulting in a strong resonating signal. This principle was utilized to make commercial anti-theft systems, for example, the anti-theft systems in supermarkets. An acousto-magnetic anti-theft system includes a detection device, deactivation device and deactivation verifier, AM tags, etc. A widely used commercially available detection device is the Ultramax™ detector made by Sensormatic Electronics Corporation. The Ultramax™ detector emits a 58 kHz pulse wave which excites active acousto-magnetic tags, leading to strong 58 kHz resonating signal that can be detected by the pick-up coils in the Ultramax™ detector. The signal is then amplified and analyzed to trigger an alarm. Deactivation is carried out by demagnetizing the bias in the acousto-magnetic tags, which will shift the resonating frequency of the acousto-magnetic tag out of the detection window, while significantly reduced the resonating amplitude. Therefore, the alarm will not be set off from a deactivated tag.

There are two types of anti-theft acousto-magnetic tags: anti-theft acousto-magnetic hard tags and anti-theft acousto-magnetic labels of tags. Anti-theft acousto-magnetic hard tags use amorphous ribbon as resonators and use permanent magnetic materials (such as bonded ferrite magnets) as bias. This type of anti-theft tag (such as Supertag™ I, II, III made by Sensormatic) can not be deactivated by the deactivators and are used inside stores repeatedly. The hard tag pinned on a soft item can be detached by a detacher after this item has been paid for, so that the paid item will no longer set off alarm at the store gate detection apparatus when the item is removed from the store.

Acousto-magnetic labels also use amorphous ribbon as the resonators, but conventionally use "semi-hard" magnetic material as the bias component. This type of acousto-magnetic labels can be repeatedly deactivated and re-activated. By demagnetizing the bias in the acousto-magnetic label glued on paid store item, the alarm will not be triggered when the item is removed from the store through the store gate detection apparatus. The bias is a key component of the acousto-magnetic label. The bias component will affect the resonating frequency to allow the detection system to differentiate the active or deactivated state of the acousto-magnetic labels. Meanwhile, the bias component significantly affects the performance and cost of producing the acousto-magnetic labels. Consequently, the development on the bias has been on-going internationally.

Since the granting of the original patent (U.S. Pat. No. 4,510,489), more patents related to the composition and methods of making new semi-hard bias materials have been granted, including U.S. Pat. No. 4,536,229 granted to Sungho Jin, et al on Aug. 20, 1985; U.S. Pat. No. 5,351,033 granted to Nen-Chin Liu, et al on Sep. 27, 1994; U.S. Pat. No. 5,716,460 granted to Neil R. Manning, et al on Feb. 10, 1998; U.S. Pat. No. 5,729,200 granted to Richard L. Copeland, et al on Mar. 17, 1998; U.S. Pat. No. 6,001,194 granted to Noriyuki Nakaoka, et al on Dec. 14, 1999; U.S. Pat. No. 6,181,245 granted to Richard L. Copeland, et al on Jan. 30, 2001; U.S. Pat. No. 6,689,490 granted to Hartwin Weber, et al on Feb. 10, 2004; U.S. Pat. No. 6,893,511 granted to Noriyuki Nakaoka, et al on May 17, 2005, and others.

"Semi-hard" magnetic materials have coercivity measured in direct current (DC) between the coercivity of soft and hard magnetic materials, which is to say that the coercivity of semi-hard magnetic materials is in the range of 10-300 Oe. The acousto-magnetic labels using a bias component formed of semi-hard magnetic materials with coercivity in the range of 56-90 Oe) will show higher stability in storage and transportation against disturbing magnetic fields in the environment. But this type of bias normally contains Cobalt (Co), which is a strategic material, or Nickel (Ni), which has a rising and fluctuating price over recent years, leading to higher cost of manufacture. For example, the earlier commercial acousto-magnetic labels used FeCrCo semi-hard bias for many years. That FeCrCo semi-hard bias contains expensive Cobalt (about 7-17% wt %).

Later, Vacuumshemelze (VAC) from Germany developed the SemiVac90™ bias formed of (FeCrCoNiMo) semi-hard bias with Hc in the range of about 70-80 Oe (as set forth in the aforementioned U.S. Pat. No. 5,729,200 and U.S. Pat. No. 6,181,245). SemiVac90™ contains lower quantities of Cobalt in the bias component, but still can not get rid of Cobalt or Nickel completely. Furthermore, Carpenter Technology Corporation (CarTech) in Reading, Pa., USA, developed a Co-free bias component MagneDur20-4™ (Fe-20Ni-4Mo, as described in the aforementioned U.S. Pat. No. 5,729,200 and U.S. Pat. No. 6,181,245). MagneDur20-4™ still contains relatively high Ni content (i.e. >8 wt %) and has a lower Hc measured at about 20 Oe. Meanwhile, VAC also developed Co-free bias Sensorvac™ (FeNiAlTi, see U.S. Pat. No. 6,689,490). However, Sensorvac™ still contains a high Ni content (8-25% wt %) and has a lower Hc at about 20 Oe.

In 1980, Dr. S. Jin from Bell Labs, USA, conducted lab studies on Fe—Ni and Fe—Mn alloy systems. (High-Remanence Square-Loop Fe—Ni and Fe—Mn Magnetic Alloys", IEEE Transactions on Magnetics Vol. Mag-16 No. 5 September, 1980.) He pointed out that cold-drawn (>80% cold deformation amount) Fe-(8-16 wt %) Mn alloy wire (not strip though) followed by 500-550 C/aging 3.5 hours, then cold drawn again (>95% cold deformation amount) followed by 450 C/aging 10 min-2 hours) shows property combinations of Hc=28 Oe/Br=18000 Gs, Hc=85 Oe/Br=15000 Gs, Hc=240 Oe/10000 Gs. However, such magnetic property combinations (either Br is good but Hc is too low, or Hc is good but Br is too low) presented difficulties for practical technical applications, long after 1980, after such cold drawn alloy wire was investigated. Specifically, such Fe—Mn alloy wire found no applications in acousto-magnetic labels which were invented in 1982. It is worth noting that the wire and strip process methods (especially the technical difficulties in processing) for wire and strip are different.

In 1996, The Arnold Engineering, USA, disclosed a strip alloy Fe-(8-18 wt %) Mn, having a composition of Fe-12.9 wt % Mn-0.01 wt % Cr, as set forth in U.S. Pat. No. 5,716,460, through method similar to that taught by Dr. Jin, but with cold reduction rate at least 40%, then aging at least 30 min at above 400 C, cold reduction again but greater than 75%, then go through a final and necessary step in this invention, which is to strand anneal the cold rolled strip above 525 C (in fact it was 525-625 C) for less then 3 min to get a material with Hc at least 20 Oe, Br at least 8000 Gs. Although the Arnold method, i.e. disclosed in U.S. Pat. No. 5,716,460, suggested that the above processed material can be used as a bias in acousto-magnetic labels, the patent does not present any acousto-magnetic label embodiments in the specification or show any acousto-magnetic label protection parameters in the claims of U.S. Pat. No. 5,716,460.

Therefore, this '460 patent does not disclose if such manufactured material can practically make qualified acousto-magnetic labels with satisfied detection range and deactivation performance. Another problem of this '460 patent is the necessary key step for final strand anneal in a fairly low temperature, such as 525 C, and fairly short time, in less than 3 min. Such a manufacturing process would provide a rather inconsistent method of manufacturing in commercial production. In fact, the limited data listed in Table 1.1 of the patent already proves that only 1 min or only a 100 C temperature difference could result in 20% variation on Hc or Br. Such highly magnetic property fluctuated bias is unlikely practical, in contrast to very tight demands on consistent magnetic properties on bias materials, due to acousto-magnetic labels having a very narrow frequency detection window in detection systems (i.e., 57.8-58.2 kHz).

Both methods of manufacture proposed respectively in the Jin and Arnold patents employed an intermediate aging process (at least 30 min, preferred over several hours) at a dual phase zone, after first cold deformation. This would not be beneficial for massive production, because a dual phase temperature zone (400-600 C) is too low for effective hydrogen reducing atmosphere protection. Re-grinding such thin strip will cause high yield loss, offsetting the cost benefits by using Co-free and Ni-free or low Ni.

The Arnold production method, as well as all prior methods to process bias, first employed four high rollers to roll the strip down to about 0.2 mm, then use multiple rollers Z-mill (such as a high precision 20 or 26 roller machine) to finish rolling the strip to about 0.05 mm, which is the commonly accepted bias thickness in the acousto-magnetic industry. It is well known that low-cost four high rollers can only obtain strip thickness down to about 0.07 mm. To roll the strip down below 0.065 mm, a multiple roller has to be used, which significantly increases the manufacturing cost of producing the strip to far above the low priced material cost (such as Fe, Mn) of the strip. Thus, the manufacturing process high cost conflicts with the economic goal of reducing costs of large-scale commercially usable bias by using Co-free or Ni-free or low Ni materials.

Another consideration, since U.S. Pat. No. 5,729,200 disclosed decreasing the coercivity of the bias component to 20 Oe, the bias developments were limited to low Hc range. However, the original idea to reduce the deactivation peak field down to as low as 35 Oe in U.S. Pat. No. 5,729,200 was not realized practically. In fact the commercially used deactivators in current systems still were having peak deactivation fields as high as several hundred Oe to ensure rapidly deactivating labels from all orientations in complex environments at the check-out counter so as to avoid false alarms.

Meanwhile, the concept of "source tagging", which is the application of acousto-magnetic labels on the products at the source of manufacturing, and then being transported by sea or land, to reach stores that can be many thousands of miles away from the manufacturing source, will have to keep a very stable magnetization state in the bias component to maintain the best activating state of acousto-magnetic labels. Some storage or transportation environments can be quite complicated, including utilization of an iron-based goods storage shelf, ferrous transfer rollers on conveyor belts, magnetic leaking field when large quantity acousto-magnetic labels are packaged together, security checking machines, different kind of electronic equipment and low frequency power line devices. Therefore, the acousto-magnetic labels made with low Hc bias are having difficulties to keep their stability. For instance, certain label supplier requires that label users avoid exposing the labels to an environment magnetic field over 8 Gs (Oe) in the datasheet. However, it is very difficult for label users to exactly determine whether their environments in storage or transportation are having such a weak magnetic field of 8 Gs (Oe). Label users have no responsibility or ability to control the environment magnetic fields.

Currently used low Hc semi-hard bias strip FeNiTiAl or FeNiMo with Hc=20 Oe all need strict controls on the aging temperature and time after cold rolling. The Hc is a rising process during the aging. Low Hc is at the range that Hc rapidly rises in the initial aging stage. Therefore, the low Hc is extremely sensitive to the aging temperature. It is easy to miss target low Hc window at 20 Oe, resulting in scraping of whole batches of final rolled strip due to over-aged Hc. Therefore, low Hc bias needs high precision production facility for manufacturing. In contrast, for high Hc (56-90 Oe) Fe-12Mn based bias strip alloy, the aging temperature range is quite wide, because the high Hc dependence on aging temperature becomes less and is flatter. It is now easy to produce large scale consistent and high quality strip for bias applications, greatly reducing the demand to the production facility precision and reduced the bias cost.

Another closely related issue is recognized by the current low Hc=20 Oe label manufacturers. If the total leaking magnetic field during the storage and transportation, resulting from packing large quantity AM labels made with low Hc bias, is above 10 Oe, these acousto-magnetic labels would start to be demagnetized by each other and lead to deterioration on label detection performance. Thus, to avoid such instability, the manufacturer uses an alternative magnetizing method to activate the acousto-magnetic labels and to control the label magnetizing directions as alternatively arranged as north and south poles, which is described briefly in U.S. Pat. No. 5,729,200, and more details on devices and methods in U.S. Pat. No. 6,020,817.

Such methods and devices increase manufacturing costs and further complicate the processes for manufacturing, storage and transportation of acousto-magnetic labels made with low Hc semi-hard bias. In contrast, by employing high Hc bias for AM labels, the labels will not be demagnetized even if they are all magnetized in same direction (or any other activating methods) and packed with thousands and ten thousands together. Therefore, the manufacturing, storage and transportation of acousto-magnetic labels can become simple and reliable.

An example of present acousto-magnetic label structure is shown in FIG. 3A in U.S. Pat. No. 6,359,563. The label structure consists of an elongated plastic housing and the cover on the housing. The cover can be made with cover film, double tape, semi-hard bias piece, and cover film, in the order from top to the bottom. At least one, or more, resonators are positioned inside the housing with the size thereof comparable to the cavity and arranged as layered structure. The shape of the bias can be a parallelogram or a parallelogram with corners being cut, or shaped in rectangular.

It would be desirable to provide a Co-free, Ni-free or low Ni (i.e. <8 wt %) high Hc bias, which can be consistently produced, along with an acousto-magnetic label made by this type of bias, to meet ever-growing demands on this product.

SUMMARY OF THE INVENTION

It is an object of this invention to overcome the disadvantages of the prior art by providing a low cost Co-free, Ni-free or low Ni (i.e., <8 wt %) high Hc bias component for use in acousto-magnetic label manufacture.

It is another object of this invention to provide a method of manufacturing a Co-free, Ni-free or low Ni (i.e., <8 wt %) high Hc bias component in large scale.

It is still another object of this invention to provide a deactivatable acousto-magnetic label containing a low cost Co-free, Ni-free or low Ni (i.e., <8 wt %) high Hc bias component.

It is yet another object of this invention to provide a packing method for shipping large numbers of acousto-magnetic labels, as well as for a magnetizing activation method under these packing combinations.

It is a feature of this invention that these labels are formed in sheet or roll formats, which produce magnetic leaking fields, but not sufficiently to cause the demagnetization of the labels by each other during transportation or storage.

It is an advantage of this invention that the technology route for the activating, storage and transportation of labels is greatly simplified.

It is another advantage of this invention that the reliability of acousto-magnetic labels is enhanced.

Aforementioned technical problems are chiefly solved through following technical solutions: A high Hc bias, made with an alloy strip consists of 10-14 wt % Mn, not over 7 wt % of one or more other transition metals (i.e. metals in groups 3-12 in the periodic table, such as Ti, V, Cr, Co, Ni, Cu, Zr, Nb, Mo, W, Zn, etc), and the balance (in the range of about 79-90% by weight) Fe, after being cold rolled to final gauge, undergoing a final aging treatment for at least 5 min time, and temperature below 590 C. The strip thickness is 0.065-0.18 mm. DC Hc is 56-90 Oe. As comparison, the high Hc (e.g. 56-90 Oe) bias in this invention employed cheaper metals such as Fe and Mn has noticeably enhanced resistance to demagnetizing caused by environment stray fields, compared to low Hc (20 Oe) bias. Thus, the AM labels made with high Hc are more stable. Meanwhile, the experiment data proven that currently used commercial deactivators can deactivate such high Hc AM label completely. In other words, it has both economic and technical advantages if a bias is Co-free, Ni-free or low Ni, easier to manufacture, lower cost and the AM label made with this bias can be deactivated reliably in current used deactivators. This bias material can certainly replace high Ni but low Hc (about 20 Oe) semi-hard bias materials.

It is another feature of this invention that this alloy strip's total sum for one or more other transition metals does not exceed 5 wt %.

As preferred, this alloy strip's Mn content is 11.5-12.5 wt %, while total sum for one or more other transition metals not exceed 2 wt %, the balance is Fe.

One manufacturing method to make high Hc bias is to cold roll the alloy strip to 0.07-0.15 mm thick, followed by aging at 450-570 C, time 0.5-20 hrs. to get the strip to have coercivity in the range of 60-85 Oe, then cut the strip into needed sizes to get high Hc bias. This alloy strip would preferably contain 10-14 wt % Mn, sum total of other transition metal or metals below 7 wt % with the balance being Fe.

As preferred, slit the aforementioned strip to 4-10 mm width, then cut into 32-40 mm as bias pieces.

A method of making high Hc bias, employs the alloy with 10-14 wt % Mn, sum total of other transition metal or metals below 5 wt % with the balance being Fe. After melting, casting, hot forge, hot roll, clean the hot band surface, softening treatment above 840 C, cold roll with 4-high roller (do not use 20 rolls or 26 rolls high precision Z-mill) to 0.07-0.09 mm, followed by long time aging below 540 C for 2-10 hours.

As preferred, after hot roll, the alloy does not go through an intermediate gage annealing at low temperature of 400-600 C in $\gamma$-$\alpha$ two phase zone, only goes through cold roll followed by 490 C/5 hours aging.

As preferred, aforementioned alloy is the strip having 11.5-12.5 wt % Mn, total sum of other transition metal or metals not exceed 2 wt %. The thickness is 0.07-0.085 mm.

An acousto-magnetic label includes in an elongated housing a magnetic bias piece. This acousto-magnetic label contains a high Hc bias, as well as at least one amorphous resonator with length=35-45 mm, width=5-10 mm. The active label resonating frequency is 57.1-58.9 kHz. Further preferred solution is the active label resonating frequency at 57.5-58.5 kHz.

An acousto-magnetic label, includes in an elongated housing a magnetic bias piece. The cavity of the house has resonators. The house has a cover consisting of double tape and cover film. The cover film, magnetic bias and resonators are arranged as layered structure. The magnetic bias is aforementioned high Hc bias.

A packing structure of the acousto-magnetic labels, the acousto-magnetic labels arranged closely on a same plane as one sheet. At least one position that the edge of an acousto-magnetic label to edge of next AM label has a gap less than 0.1 mm, which can result in a sheet consisting of 40-120 labels. Every box of commercially sold acousto-magnetic labels has at least 20 sheets of such labels. In each sheet, the bias with same magnetization direction has percentage 50%-100%.

Another packing structure of the AM labels, the mentioned AM labels arranged in parallel but all vertical to the supporting liner's length direction to form rolls. The edge of one acousto-magnetic label to the edge of the next acousto-magnetic label has a gap of 2-4 mm, which can result in a roll formed with 2000-8000 labels. Every carton of commercially sold acousto-magnetic labels has at least one roll of such labels. In each roll, the bias with same magnetization direction has percentage 50%-100%.

Compared to prior art, this invention has following features:

1. This invention overcame technical prejudice that high Hc materials must have Co, Ni, and proven that very low cost Fe-(10-14 wt % Mn) can get high Hc after going through the process steps disclosed in this invention;

2. The method disclosed in this invention eliminated the conventional bias manufacturing method utilizing Z-mill (20 or 26 high precision rollers) with high process costs, saved expensive finishing costs, kept the low material cost advantage of Fe—Mn alloy bias.

3. This invention does not utilize an intermediate aging heat treatment that was conventionally regarded as indispensable, saving process cost and material cost. The technology becomes simple and convenient.

4. The manufacturing method of the bias component disclosed in this invention, breaks a technical prejudice that the Fe-(8-18 wt %) Mn material final gauge anneal time can not be over 3 min, extending the final annealing time to a 1-10 hour window, which makes it simple and controllable to manufacture large scale bias with consistent Hc.

5. The acousto-magnetic label, in this invention, uses the high Hc low cost Fe-(10-14 wt %) Mn bias, which leads to greatly enhanced label stability and advantageous in cost saving. Meanwhile, the bias manufactured under the principles of the instant invention breaks the prejudice that acousto-magnetic labels made with bias of Hc=60 Oe are not easy to be deactivated by currently used commercial deactivators. The labels in this invention have very strong market competiveness and vitality.

6. The acousto-magnetic label, in this invention, uses the high Hc low cost Fe-(10-14 wt %) Mn bias. The acousto-magnetic label leads to greatly enhanced label stability and is advantageous in cost. Meanwhile, the acousto-magnetic label breaks the prejudice that acousto-magnetic labels must be activated by alternative magnetic pole magnetizing method. As a result, the label activation, storage and transportation become easy and reliable.

BRIEF DESCRIPTION OF THE DRAWINGS

The advantages of this invention will be apparent upon consideration of the following detailed disclosure of the invention, especially when taken in conjunction with the accompanying drawings wherein:

The drawing FIGURE is a schematic structure for the acousto-magnetic label in this invention.

DETAILED DESCRIPTION OF THE PREFERRED EMBODIMENT

Referring now to the drawing, an acousto-magnetic label incorporating the principles of the instant invention can best be seen. The technique used in following embodiments, unless specifically stated, all are conventional technique by the arts in the field. All instrument and equipment, unless specifically stated, are can all be obtained from public knowledge by the art in the field.

Embodiment 1

Melt alloy materials (12.1 wt % Mn, 0.05 wt % Cr, balance Fe) into an ingot, hot forge, hot rolled to 5 mm thick, cleaning surface oxidation layer, cold roll to 0.5 mm, rapidly soften at 850 C single phase zone to prevent excessive oxidation during softening heating. Use 4-high directly cold roll the strip to 0.08 mm. After aging the strip in a vacuum furnace at 490 C/6 hr dual phase zone, slit the strip into 6 mm wide coils. Then use high speed cutters to cut the strip into bias pieces with lengths of 38 mm. The typical magnetic properties of this Fe—Mn bias are listed in Table I.

Embodiment 2

Melt alloy materials (12.8 wt % Mn, 1.1 wt % Ni, 0.05 wt % Cr, balance Fe) into an ingot, hot forge, hot rolled to 5 mm thick, cleaning surface oxidation layer, cold roll to 0.5 mm, rapidly soften at 850 C single phase zone to prevent excessive oxidation during softening heating. Use 4-high directly cold roll the strip to 0.115 mm. After aging the strip in a vacuum furnace at 540 C/2.5 hr dual phase zone, slit the strip into 6 mm wide coils. Then use high speed cutters to cut the strip into bias pieces with a length of 36 mm. The typical magnetic properties of this Fe—Mn bias are listed in Table I.

Embodiment 3

Melt alloy materials (10.5 wt % Mn, 1.1 wt % Mo, 0.05 wt % Cr, 0.3 wt % Ti, balance Fe) into an ingot, hot forge, hot rolled to 5 mm thick, cleaning surface oxidation layer, cold roll to 0.5 mm, rapid soften at 850 C single phase zone to prevent excessive oxidation during softening heating. Use 4-high directly cold roll the strip to 0.08 mm. After aging the strip in a vacuum furnace at 570 C/1 hr dual phase zone, slit the strip into 6 mm wide coils. Then use high speed cutters to cut the strip into bias pieces with a length of 36 mm. The typical magnetic properties of this Fe—Mn bias are listed in Table I.

The above bias pieces can be used to make acousto-magnetic labels which have an elongated housing 3, a magnetic bias 1, and resonators 2 placed into the resonating cavity in the housing 3. The housing cover 5 is made with double side tape 7 and cover film 4. Cover film 4, magnetic bias 1 and three resonators 2 are arranged as a layered structure, as shown in the drawing FIGURE. The resonator 2 is made with FeNiMoB amorphous having a preferred width of 6 mm. The detection performance of such an acousto-magnetic label manufactured according to the instant invention is compared to that of low coercivity bias DR label and is listed in Table II The deactivation (demagnetization) performance of an acousto-magnetic label made with embodiment 1 (Hc=63 Oe) is compared to that of DR label made with semi-hard bias (Hc=20-25 Oe) and is listed in Table III.

TABLE I

The typical magnetic properties for Fe—Mn based alloys in embodiments 1-3

| Embodiment | Aging temperature (C.) | Aging time (hr) | Hc (Oe) | Br (Gs) | Bm * (Gs) | Br/Bm |
|---|---|---|---|---|---|---|
| 1 | 490 | 6 | 63 | 11200 | 12800 | 88% |
| 2 | 540 | 2.5 | 68 | 7300 | 9200 | 80% |
| 3 | 570 | 1 | 89 | 3900 | 6000 | 65% |

* Note:
Bm is the magnetic induction at the maximum test magnetic field 150 Oe

TABLE II

The comparison detection performance results from AM anti-theft labels made with high coercivity Fe—Mn bias in embodiment 1 and from DR labels made with low coercivity bias

| | The longest detection distance (cm) in the AM label detection system | | | |
|---|---|---|---|---|
| | Sample A | | Sample B | |
| Labels | Direction 1 | Reverse to direction 1 | Direction 1 | Reverse to direction 1 |
| Label (embodiment 1 bias) | 76 | 81 | 78 | 82 |
| DR label | 78 | 80 | 80 | 83 |

Notes:
1. DR label: The label made with FeNiCoSiB resonators and bias with low Hc = 20-25 Oe, manufactured by Sensormatic in USA.
2. The detection system is widely used Ultrapost ™ single panel detector, manufactured by Sensormatic, USA. The test is done by putting the label length vertical to the panel surface to find the longest alarming distance. Then reverse the label direction for finding another longest detection distance.

Table II shows that both this invented label and presently commercially using DR label, can reliably set off alarm in currently commercially using detector, which is important base for this invented label to be used in current market.

TABLE III

The comparison deactivation performance results from this invented AM anti-theft labels-made with high coercivity (56-90 Oe) bias and from DR labels made with low coercivity (20-25 Oe) semi-hard magnetic bias

| The distance from the deactivator surface and active label | The distances that can be detected by AM label verifier from deactivated labels | |
|---|---|---|
| | DR label | Label in embodiment 1 |
| Deactivator 1, 8 cm | 0 cm (fully deactivated) | 0 cm (fully deactivated) |
| Deactivator 1, 9 cm | 0 cm (fully deactivated) | 0 cm (fully deactivated) |
| Deactivator 2, 15 cm | 0 cm (fully deactivated) | 0 cm (fully deactivated) |
| Deactivator 2, 18 cm | 0 cm (fully deactivated) | 0 cm (fully deactivated) |

Notes:

1. From a preset distance, bring the labels from far to close to the label detector surface to verify deactivation performance.
2. Deactivator 1: Sensormatic's Slimpad ™, label length parallel to the deactivator's surface. Deactivator 2: Sensormatic's RapidPad ™, label length vertical to the deactivator's surface.
3. AM label verifier: Sensormatic's double checker Table III shows that both this invented label and presently commercially using DR label, can reliably be deactivated in currently commercially using deactivators, which is important base for this invented label to be used in current market.

The tests on stability against mechanical damaging to the labels made with high coercivity Fe—Mn bias.

Completely bend the labels made with bias of embodiment 1 to 90 degree to form a complete kink by plastic deformation, along the length direction at about half length of each label. Then, bend the label back to recover the flat shape, the bias is plastically deformed again to substantially recover the original shape. Test the resonating frequencies before and after the bending. Table IV lists the results.

TABLE IV

The tests on stability against mechanical damaging to this invented AM labels with high coercivity bias

| Sample Number (embodiment 1 bias) | Frequency increasing (kHz) |
|---|---|
| 1 | 0.19 |
| 2 | 0.22 |
| 3 | 0.09 |
| 4 | 0.18 |
| 5 | 0.15 |

Table IV show that at least one acousto-magnetic label manufactured according to the principles of the instant invention after aforementioned bending has resonating frequency increasing less than 0.195 kHz. Therefore, this acousto-magnetic label has very strong ability against mechanical damages. To commercially available detection system with detection frequency window 57.7-58.3 kHz, the above damage will have limited effects, therefore this acousto-magnetic label detection performance will not have big change after intentionally or unintentionally bending.

The test results on the stability against the demagnetization field formed by packing large quantity of AM labels made with high coercivity Fe—Mn bias:

Magnetize 25000 labels made with embodiment 1 bias in one direction, and mark magnetic north pole on each label, then test labels by the method described in table II, select labels with detection distance over 75 cm in both test directions, to be used by following experiments:

Packing Method 1:

Sheet format packing: each sheet has 4×12=48 labels. Each box has 105 sheets with total 5040 aforementioned labels. The north pole of each label towards same direction. Packing the labels into box. Open box and take out labels, simulating the customer usage way. Test all labels by the method specified in Table II. The results shown all packed labels remain detection distance above 75 cm in both test direction with full passing results. This proven that the labels will not be self-deactivation even if they are under the possible maximum demagnetization field formed. The labels are very stable therefore no need to make limitation on their magnetization directions.

Packing Method 2:

Roll format packing: each roll has 5000 labels with inner diameter 75 mm. PET base liner width 48 mm, the label length is vertical the PET liner length direction. The space between labels are 3 mm. Total three rolls are packed into one box. Three rolls are packed with same axis. The north pole of each label towards same direction. Open box and take out middle roll, simulating the customer usage way. Test all labels by the method specified in Table II. The results shown all packed 5000 labels remain detection distance above 75 cm in both test direction with full passing results. This proven that the labels will not be self-deactivation even if they are under the possible maximum demagnetization field formed in this packing method. The labels are very stable therefore no need to make limitation on their magnetization directions.

It should be understood that this example is used to describing the invention but not limit the invention. Utilizing the bias in this invention can make various AM labels with various structures. This specification only uses embodiment 1 bias as an example to describe the application of this invention bias. It should be comprehensive that the art in the field, after reading the specification, can alter and modify to this invention. But these equivalents will still fall into attached claim ranges of this invention.

Having thus described the invention, what is claimed is:

1. A bias piece for acousto-magnetic labels, comprising:

an alloy strip having 10-14% by weight of Manganese, less than 7% by weight of one or more other transitional metals, and substantially balance Iron, cold rolled to final thickness of between 0.065-0.18 mm, with a final aging heat treatment at below 590 C for a period of time longer than 5 minutes to establish a coercivity measured by direct current method in the range of 56-90 Oe with a ratio of the residual magnetic flux density to the maximum magnetic flux density (Br/Bm) in the range of 65-88% where Bm is the magnetic induction at a maximum test magnetic field 150 Oe.

2. The bias piece of claim 1 wherein the content of said one or more transitional metals is less than 5% by weight.

3. The bias piece of claim 1 wherein the content of said one or more other transitional metals is less than 2% by weight with the manganese content being in the range of 11.5-12.5% by weight.

4. A method of making a high coercivity bias piece for an acousto-magnetic security label, comprising the steps of:

providing a strip of alloy material having 10-14% by weight of Manganese, less than 7% by weight of one or more other transitional metals, and substantially balance Iron;

cold rolling the strip of alloy material to a thickness in the range of 0.07-0.15 mm;

then, aging the strip of alloy material at a temperature in the range of 450-570 degrees C. for a period of time in the range of 0.5-20.0 hours to form a magnetic strip with coercivity in the range of 60-85 Oe with a ratio of the residual magnetic flux density to the maximum magnetic flux density (Br/Bm) in the range of 65-88% where Bm is the magnetic induction at a maximum test magnetic field 150 Oe; and cutting the aged strip of alloy material to required size to form high coercivity bias piece.

5. The method of claim 4 wherein the cutting step includes the steps of:

slitting the aged strip of alloy material to a width of 4-10 mm; and then, trimming the aged strip of alloy material to a length of 32-40 mm.

6. A method of making a high coercivity bias piece for an acousto-magnetic security label, comprising the steps of:

providing alloy material having 10-14% by weight of Manganese, less than 7% by weight of one or more other transitional metals, and substantially balance Iron;

melting said alloy material and casting the melted alloy material into a strip;

hot rolling the formed strip and cleaning the hot rolled surface of said strip;

softening said strip at a temperature higher than 840 degrees C.;

then, using a 4-high roller to roll the strip down to a thickness in the range of 0.07-0.09 mm; and then, aging said rolled strip at temperatures less than 540 degrees C. for a period of time in the range of 2-10 hours to create said bias piece with a coercivity in the range of 60-85 Oe with a ratio of the residual magnetic flux density to the maximum magnetic flux density (Br/Bm) in the range of 65-88% where Bm is the magnetic induction at a maximum test magnetic field 150 Oe.

7. The method of claim 6 wherein said alloy strip has thickness of 0.07-0.085 mm and has a manganese content in the range of 11.5-12.5% by weight, less than 2% by weight of one or more other transitional metals.

8. An anti-theft acousto-magnetic security label, comprising:

an elongated resonating housing;

a magnetic bias piece formed of a alloy material including 10-14% by weight of Manganese, less than 7% by weight of one or more transitional metals, and substantially balance Iron, said bias piece having a coercivity in the range of 60-85 Oe and a ratio of the residual magnetic flux density to the maximum magnetic flux density (Br/Bm) in the range of 65-88% where Bm is the magnetic induction at a maximum test magnetic field 150 Oe; and at least one amorphous resonator having a length in the range of 35-45 mm and a width in the range of 5-10 mm with an activating resonating frequency in the range of 57.1-58.9 kHz.

9. The anti-theft acousto-magnetic security label of claim 8 wherein the activating resonating frequency is in the range of 57.5-58.5 kHz.

10. Anti-theft acousto-magnetic security labels, each said security label comprising:

an elongated resonating housing;

a magnetic bias piece;

at least one resonator positioned within the resonating housing; and a cover made of double side tape and cover film, the cover film, magnetic bias piece and resonators being arranged in a layered configuration, the security labels being mounted on a sheet arranged in a planar configuration with a total of 40 to 120 security labels mounted on each sheet, each respective security labels on the sheet being spaced from the other said security labels by a gap having a dimension of less than 0.1 mm.

11. The security labels of claim 10 wherein each said sheet of security labels are oriented with at least half the labels oriented in the same magnetizing direction.

12. The security labels of claim 10 wherein each said security label is formed from an alloy material having 10-14% by weight of Manganese, less than 7% by weight of one or more other transitional metals, and substantially balance Iron.

13. The security labels of claim 10 wherein the labels are closely packed with label length vertical to base liner length direction to form a roll format with total 2000-8000 security labels per roll, the respective security labels being spaced from one length edge to the adjacent security label length edge by a distance of 2-4 mm.

* * * * *